US007658413B2

(12) United States Patent
Malone

(10) Patent No.: US 7,658,413 B2
(45) Date of Patent: Feb. 9, 2010

(54) RETRACTABLE SNOW POLE AND SNOWBOARD BINDING COMBINATION

(76) Inventor: Andon Malone, 5820 E. Cayley La., Castlerock, CO (US) 80104

( * ) Notice: Subject to any disclaimer, the term of this patent is extended or adjusted under 35 U.S.C. 154(b) by 358 days.

(21) Appl. No.: 11/688,690

(22) Filed: Mar. 20, 2007

(65) Prior Publication Data

US 2007/0164551 A1 Jul. 19, 2007

Related U.S. Application Data

(63) Continuation-in-part of application No. 10/883,188, filed on Jul. 2, 2004, now abandoned.

(51) Int. Cl.
*A63C 11/22* (2006.01)

(52) U.S. Cl. ..... 280/823; 280/819; 280/14.22; 135/75

(58) Field of Classification Search ..... 280/819, 280/823, 809, 813, 14.21, 14.22, 14.24; 135/65, 135/75; 248/188.5; 43/18.1 CT, 18.1 HR
See application file for complete search history.

(56) References Cited

U.S. PATENT DOCUMENTS

| | | | | | |
|---|---|---|---|---|---|
| 433,270 | A * | 7/1890 | Bergesen | 135/25.32 |
| 489,385 | A * | 1/1893 | Meily et al. | 40/317 |
| 2,041,334 | A * | 5/1936 | Hage | 40/317 |
| 2,156,984 | A * | 5/1939 | Haupt | 135/26 |
| 2,427,841 | A * | 9/1947 | Dichter | 403/109.3 |
| 2,687,138 | A * | 8/1954 | Okun | 135/75 |
| 3,011,810 | A * | 12/1961 | Crowder | 403/328 |
| 3,093,402 | A * | 6/1963 | Sisson | 294/19.1 |
| 3,556,543 | A * | 1/1971 | Overgaard et al. | 280/632 |
| 3,797,845 | A * | 3/1974 | Kepka et al. | 280/822 |
| 3,915,102 | A * | 10/1975 | Barron | 108/146 |
| 3,963,037 | A * | 6/1976 | Clark | 135/65 |
| 3,987,807 | A * | 10/1976 | Varnell | 135/66 |
| 4,145,062 | A * | 3/1979 | Stiemert | 280/813 |
| 4,152,007 | A * | 5/1979 | Smith | 280/605 |
| 4,165,887 | A * | 8/1979 | Bunn, Jr. | 280/613 |
| 4,214,770 | A * | 7/1980 | Agins | 280/819 |
| 4,237,639 | A * | 12/1980 | Uemori et al. | 43/18.1 CT |
| 4,279,433 | A * | 7/1981 | Petaja | 280/605 |
| 4,582,079 | A * | 4/1986 | Fields | 135/75 |
| 4,681,246 | A * | 7/1987 | Andersson | 224/267 |
| 5,036,873 | A * | 8/1991 | Clayton | 135/69 |
| 5,094,479 | A * | 3/1992 | Shields | 280/814 |
| 5,359,797 | A * | 11/1994 | Williamson | 280/816 |
| 5,740,998 | A * | 4/1998 | Lindsay et al. | 248/407 |
| 5,941,435 | A * | 8/1999 | Munro, III | 224/267 |
| 6,020,818 | A * | 2/2000 | Chittenden | 340/568.6 |
| 6,029,998 | A * | 2/2000 | Woodard | 280/819 |
| 6,217,072 | B1 * | 4/2001 | Gregg | 280/823 |
| 6,217,073 | B1 * | 4/2001 | Hoffman | 280/823 |
| 6,341,614 | B1 * | 1/2002 | Tucker et al. | 135/75 |

(Continued)

*Primary Examiner*—S. Joseph Morano
*Assistant Examiner*—Vaughn T Coolman
(74) *Attorney, Agent, or Firm*—Veronica-Adele R. Cao; Weiss & Moy, P.C.

(57) ABSTRACT

A snow pole and snow board binding combination is disclosed. The snow pole is conveniently stored on a snowboard binding. The snow pole has telescoping pole members that may be automatically extended from an interior portion of a housing of the snow pole and may be automatically retracted into an interior portion of a housing of the snow pole. The snow pole may have an emergency flag system that is contained within the housing of the snow pole.

17 Claims, 11 Drawing Sheets

U.S. PATENT DOCUMENTS 6,345,843 B1 * 2/2002 Barnes ..... 280/823
6,938,927 B1 * 9/2005 Martin et al. ..... 280/819
7,172,219 B2 * 2/2007 Spragg et al. ..... 280/823
7,201,401 B1 * 4/2007 Friedman ..... 280/823
7,299,765 B1 * 11/2007 Phelps ..... 116/173
7,377,551 B2 * 5/2008 Silverman et al. ..... 280/819
7,461,476 B1 * 12/2008 Davis ..... 43/18.1 R
7,490,858 B1 * 2/2009 Sellers et al. ..... 280/814
2002/0141812 A1 * 10/2002 Edelen et al. ..... 403/109.1
2007/0222168 A1 * 9/2007 Sellers et al. ..... 280/79.7

* cited by examiner

FIGURE 3
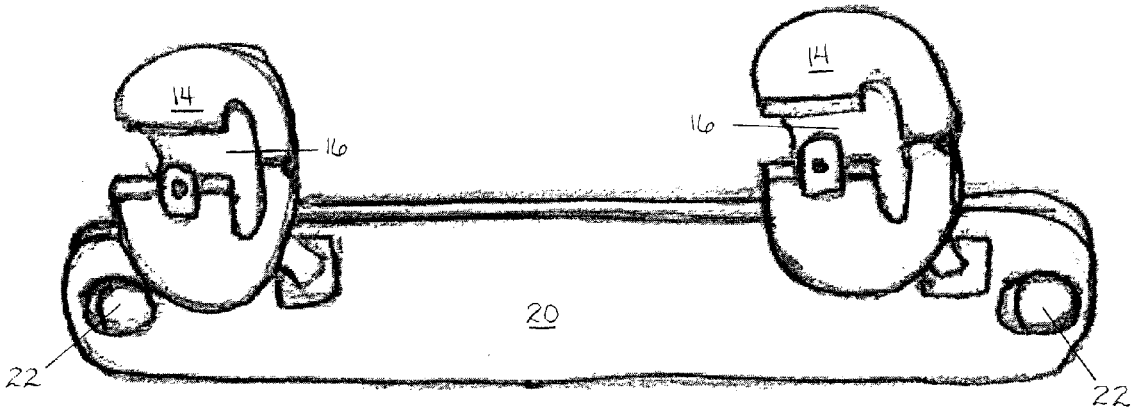
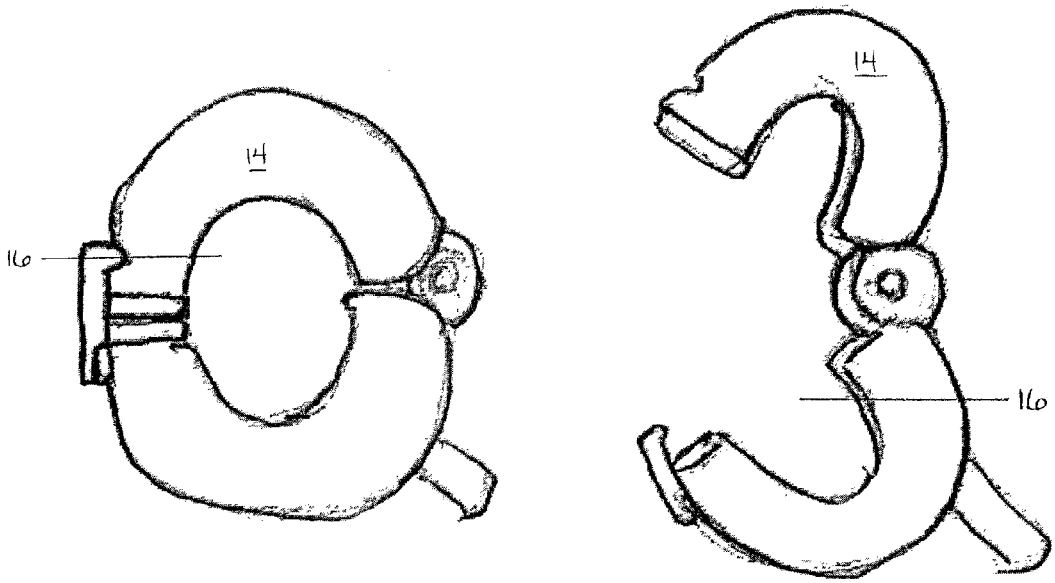
FIGURE 4

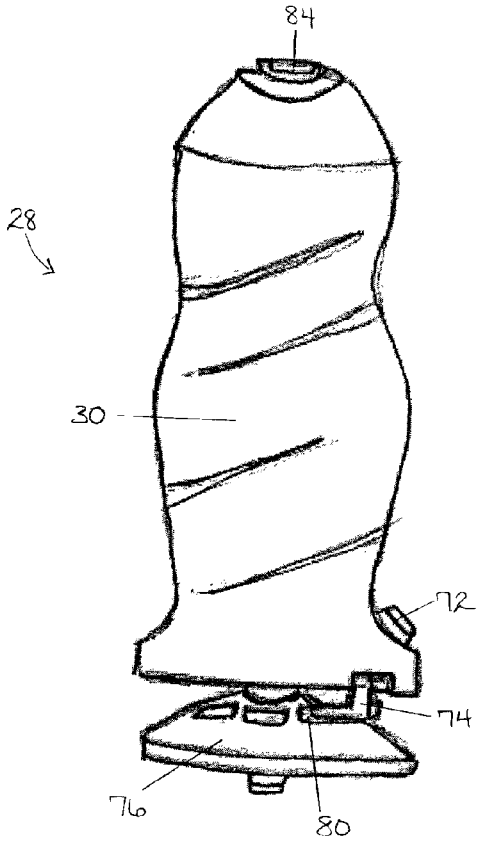
FIGURE 5
FIGURE 6
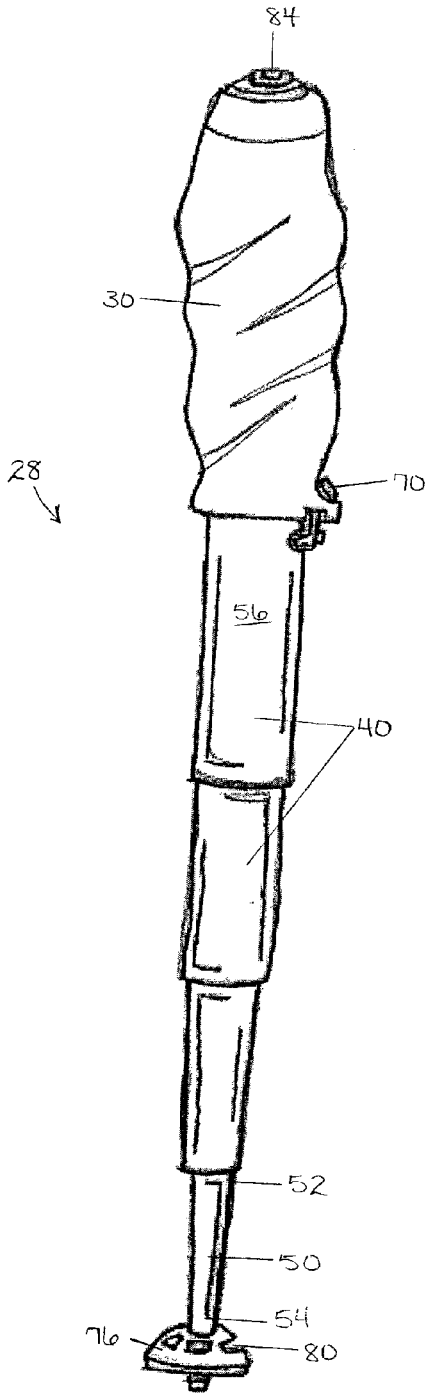

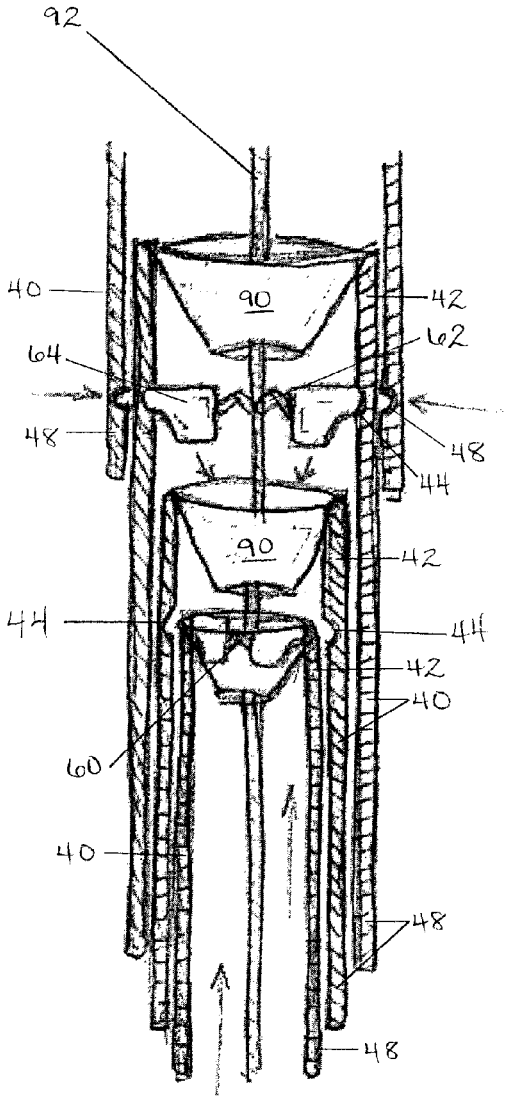
FIGURE 12
FIGURE 13
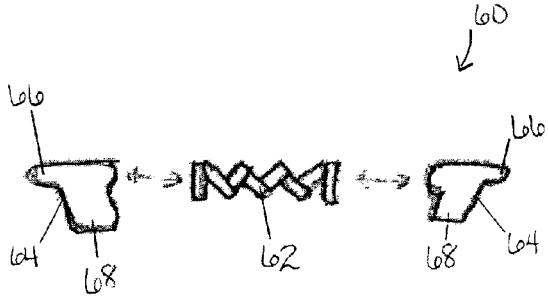
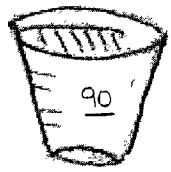
FIGURE 14

FIGURE 15
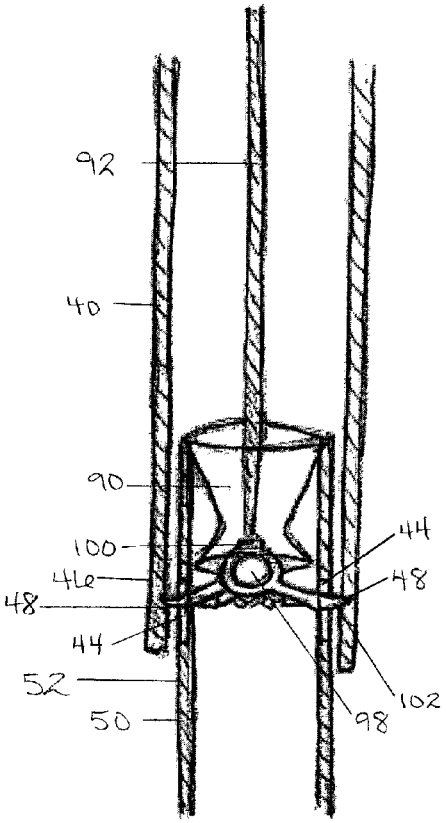
FIGURE 16
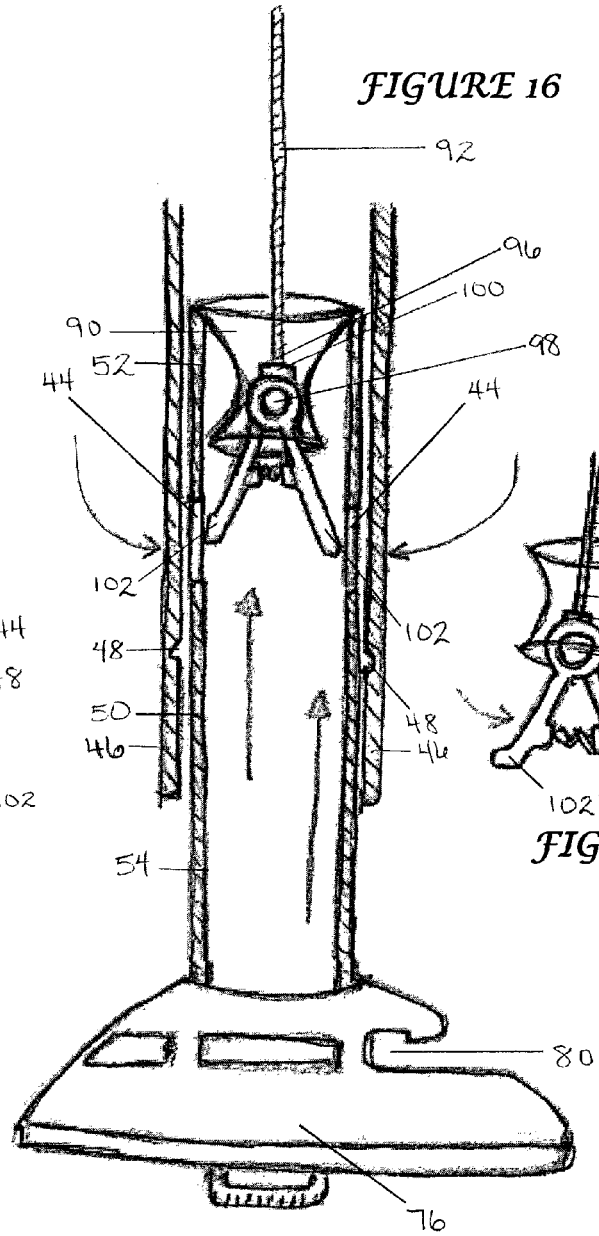
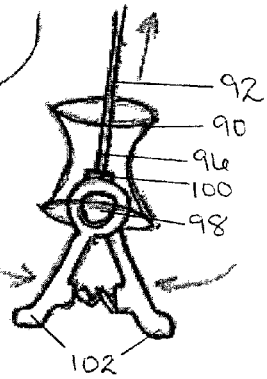
FIGURE 17
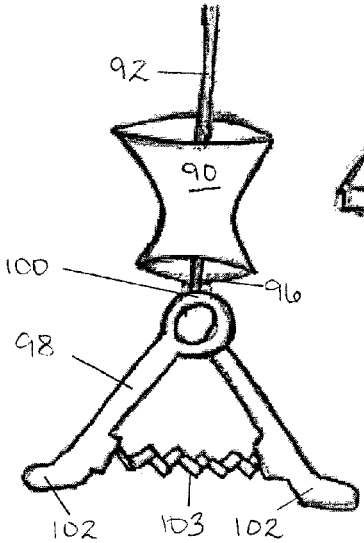
FIGURE 18

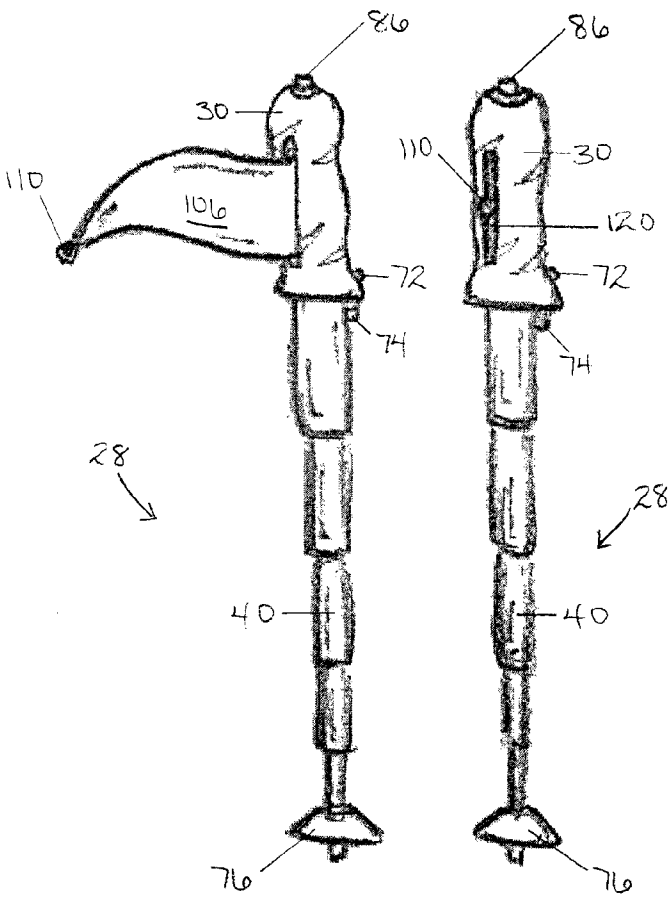
FIGURE 20
FIGURE 21
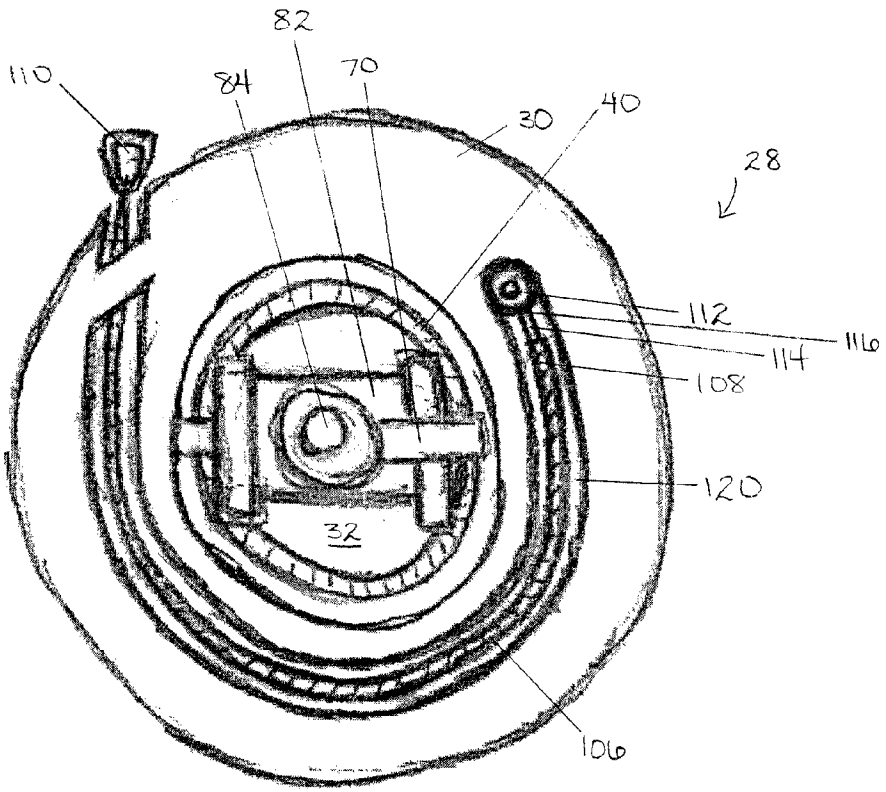
FIGURE 19

RETRACTABLE SNOW POLE AND SNOWBOARD BINDING COMBINATION

CROSS-REFERENCE TO RELATED APPLICATION

This is a continuation-in-part of U.S. patent application Ser. No. 10/883,188 filed Jul. 2, 2004 now abandoned in the name of the Applicant, to which priority is claimed.

FIELD OF THE INVENTION

This invention relates generally to snow poles and more specifically to a snow pole and snowboard binding combination wherein the snow pole may be automatically extended from and retracted into an interior portion of a housing of the snow pole and wherein the snow pole may be conveniently stored on the snowboard binding.

BACKGROUND OF THE INVENTION

Snowboarding has become a popular past-time for many people. Snowboarding differs from skiing principally in the use of a single board with two spaced apart bindings for a person's feet instead of two skis with a binding for each foot of the person. A skier typically uses two ski poles to control motion on snow surfaces. Generally, a ski pole is not used by snowboarders, since the snowboard is wider than a ski and usually a person is able to maneuver the snowboard like a surfboard. A snowboarder controls the snowboard by shifting the snowboarder's weight from side to side like a surf board.

In some situations, such as when the slope of a hill is flat, the snowboarder may lose momentum. Instead of having to unstrap one's boots from their snowboard bindings to walk the snowboard across the flat slope, it would be useful for a snowboarder to have a snow pole to help push the snowboard along while remaining strapped into the snowboard bindings. Additionally, a pole would also be useful when a snowboarder is unable to use a foot for safely maneuvering the snowboard.

Collapsible and adjustable poles for skiing are known. Hoffman, U.S. Pat. No. 6,217,073 disclosed a manually extendable and retractable shaft for a snow pole with a basket or plate at one end of the snow pole shaft. The basket or plate end of the snow pole is placed against the snow surface, so that the snowboarder can push along the surface of the snow. According to Hoffman's disclosure, the collapsible snow pole is substantially a regular-sized ski pole which must be carried like a small ski pole by the snowboarder and does not permit hands-free snowboarding. Furthermore, the Hoffman snow pole is very large and is attached to the snowboard in between the snowboard bindings. Most snowboarders would find this to be cumbersome and dangerous, because it leaves very little room for a snowboarder to place his/her rear boot when getting on and off the chair lift. Such a large snow pole may also prove to be dangerous for freestyle snowboarders riding through a terrain park, because the snow pole could detach from the snowboard and hit the snowboarder or someone else.

The present inventor has recognized the need for a snow pole and snowboard binding combination that allows the snow pole to be conveniently and safely stored on the snowboard binding so that the snowboarder may ride the snowboard hands-free. The snow pole will also preferably be automatically extendable and retractable. The present inventor's snow pole also has additional advantages including an emergency flag housed within the handle of the snow pole and a homing device which may be activated by the snowboarder during an emergency.

SUMMARY OF THE INVENTION

Accordingly, it is an object of this invention to provide an improved snow pole and snowboard binding combination that allows the snow pole to be conveniently and safely stored on a snowboard binding.

It is a further object of the present invention to provide an improved snow pole having pole members that may be automatically extended from an interior portion of a housing of the snow pole.

It is a still further object of this invention to provide an improved snow pole having pole members that may be automatically retracted into an interior portion of a housing of the snow pole.

It is a further object of this invention to provide an emergency flag system that is contained within the housing of the snow pole.

BRIEF DESCRIPTION OF THE PREFERRED EMBODIMENTS

In accordance with one embodiment of the present invention, a snow pole and snowboard binding combination is disclosed. The combination comprises a snow pole and a snowboard binding having attachment means for removably coupling the snow pole to the snowboard binding.

In accordance with one embodiment of the present invention, a snow pole and snowboard binding combination is disclosed. The combination comprises a snow pole that comprises: a housing; a plurality of telescoping pole members slidably coupled together and having a plurality of locking pins for securing the pole members in an extended position, the pole members being located within an interior portion of the housing; a release lever having: a first end protruding out of an aperture defined by the housing; and an L-shaped second end removably coupled to an aperture defined by a pole tip coupled to a distal end of an innermost pole member when the snow pole is in a retracted position; wherein depressing the first end of the release lever causes the L-shaped second end to pivot out from the aperture defined by the pole tip; and means for retracting the pole members into the housing. The combination also comprises a snowboard binding comprising: a mounting plate coupled to a side portion of the snowboard binding; and at least one clamp lock coupled to the mounting plate.

In accordance with another embodiment of the present invention, a combination snow pole and snowboard binding is disclosed. The combination comprises a snow pole comprising: a housing; a plurality of telescoping pole members slidably coupled together and having a plurality of locking pins for securing the pole members in an extended position, the pole members being located within an interior portion of the housing; means for extending the pole members out of the housing; means for retracting the pole members into the housing; and an emergency flag assembly contained within the housing. The combination also comprises a snowboard binding having attachment means for removably coupling the snow pole to the snowboard binding.

The foregoing and other objects, features, and advantages of the present invention will be apparent from the following, more particular, description of the preferred embodiments of the invention, as illustrated in the accompanying drawings.

BRIEF DESCRIPTION OF THE DRAWINGS

FIG. 3 is a front view of a mounting plate and two clamp locks coupled thereto, the clamps are shown in an open position and are shown without the snow pole.

FIG. 4 is a side view of two clamp locks, one shown in an open position and one shown in a closed position.

FIG. 5 is a side view of a snow pole in a retracted position.

FIG. 6 is a side view of the snow pole of FIG. 5 in an extended position.

FIG. 12 is a side cross-sectional view of several locking pins and tapered stopper rings coupled to several pole members.

FIG. 13 is an exploded view of a locking pin of FIG. 12.

FIG. 14 of a side view of a tapered stopper ring of FIG. 12.

FIG. 15 is a side cross-sectional view of the snow pole revealing a spring lock shown engaging both an aperture defined by a proximal end of an innermost pole member and engaging an aligning aperture defined by a distal end of a preceding pole member.

FIG. 16 a side cross-sectional view of the snow pole revealing the spring lock of FIG. 15 shown disengaging the aperture defined by the proximal end of the innermost pole member and disengaging the aligning aperture defined by the distal end of the preceding pole member.

FIG. 17 is a side view of the spring lock of FIG. 16.

FIG. 18 is a side view of the spring lock of FIG. 15.

FIG. 19 is top cross-sectional view of the snow pole, showing a flag assembly stored within the housing.

FIG. 20 is a side view of the snow pole showing the flag in a deployed position.

FIG. 21 is a side view of the snow pole of FIG. 20 showing the flag in a stored position.

DETAILED DESCRIPTION OF THE PREFERRED EMBODIMENTS

Figure 1:
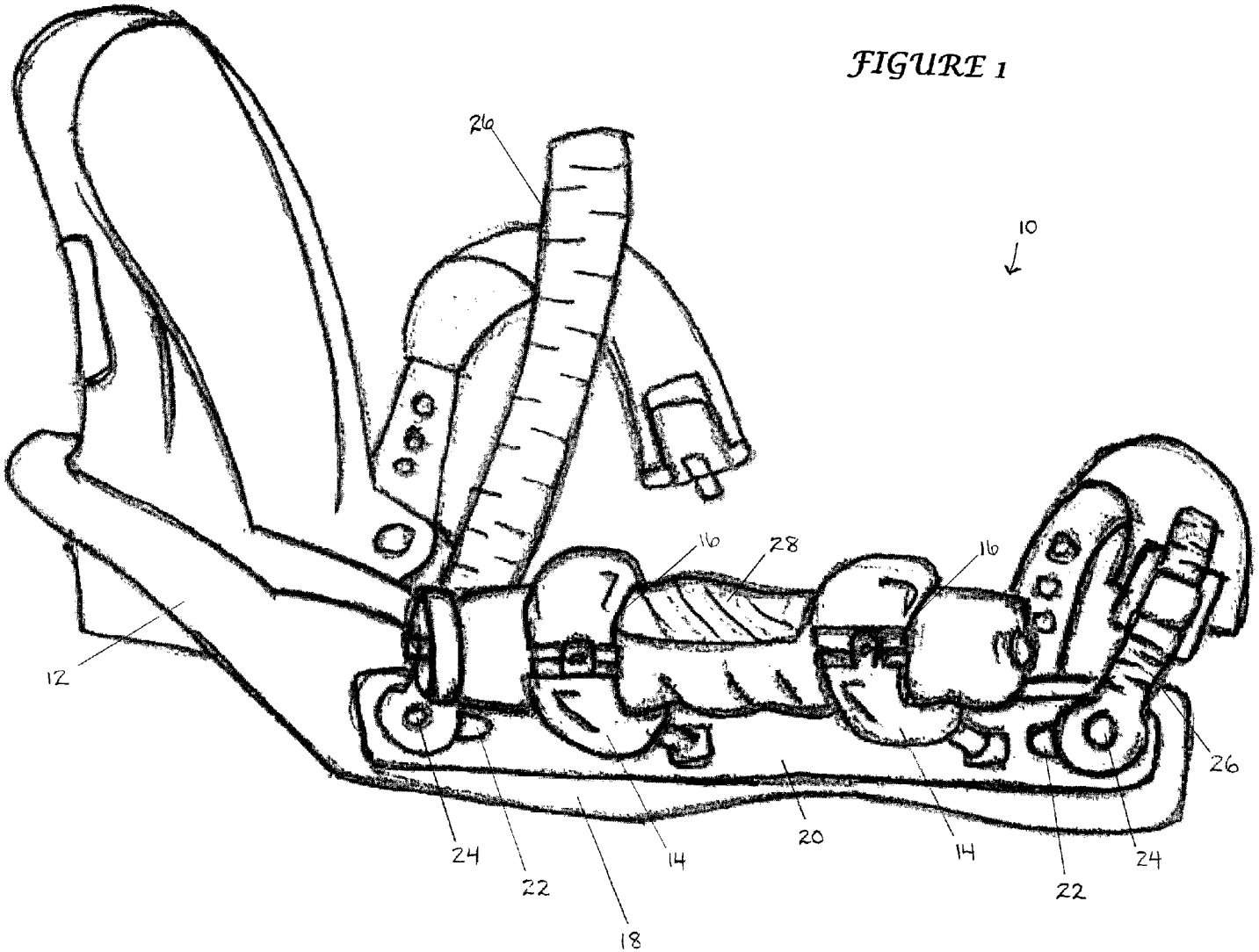
FIG. 1 is a side view of a snow pole and snowboard binding combination of the present invention.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

FIGS. 1-24 disclose a snow pole and snowboard combination of the present invention. The combination 10 comprises a snow pole 28 that is removably coupled to a snowboard binding 12.

Figure 2:
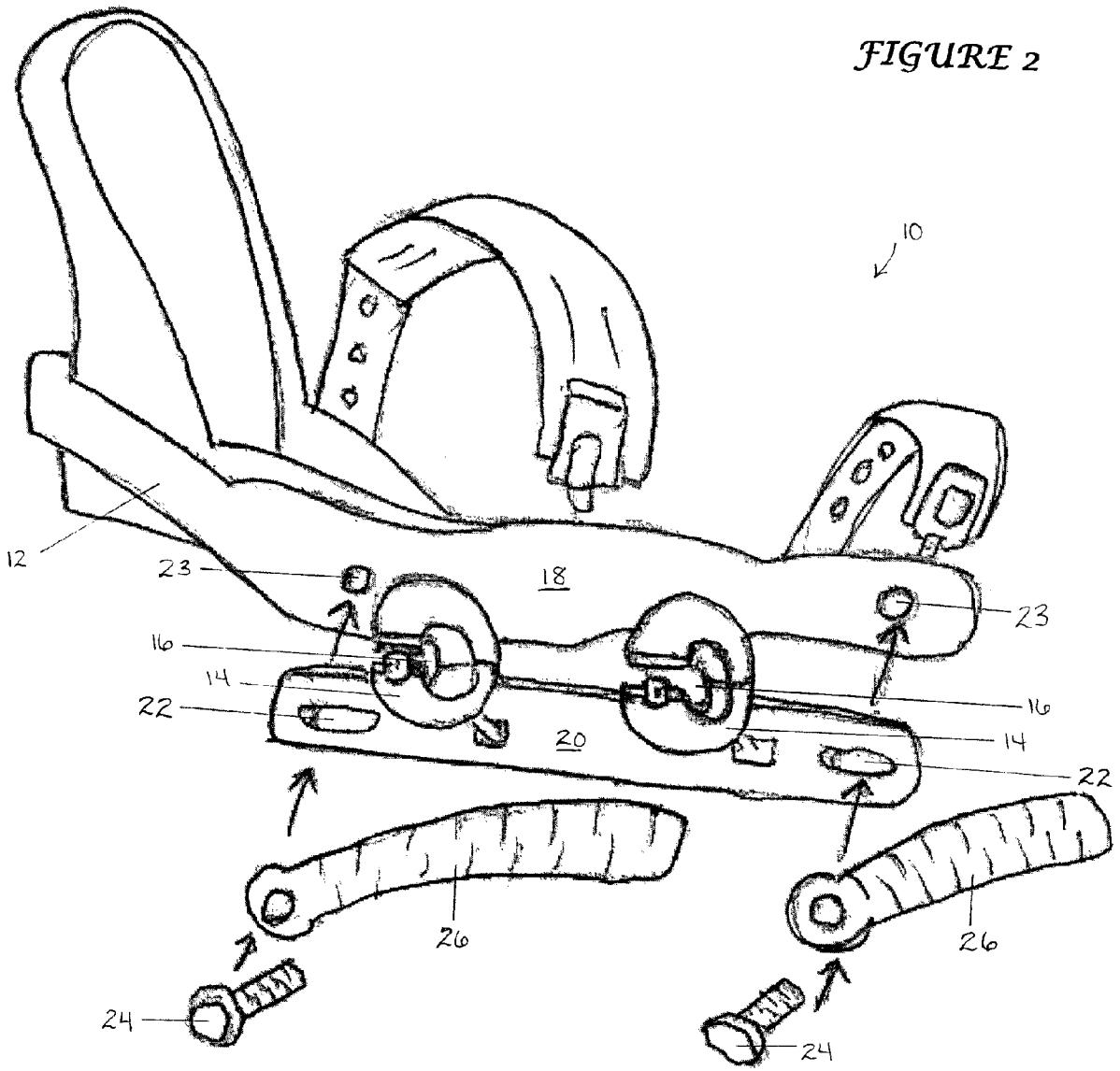
FIG. 2 is an exploded view of the snow pole and snowboard binding combination of FIG. 1.
Figure 7:
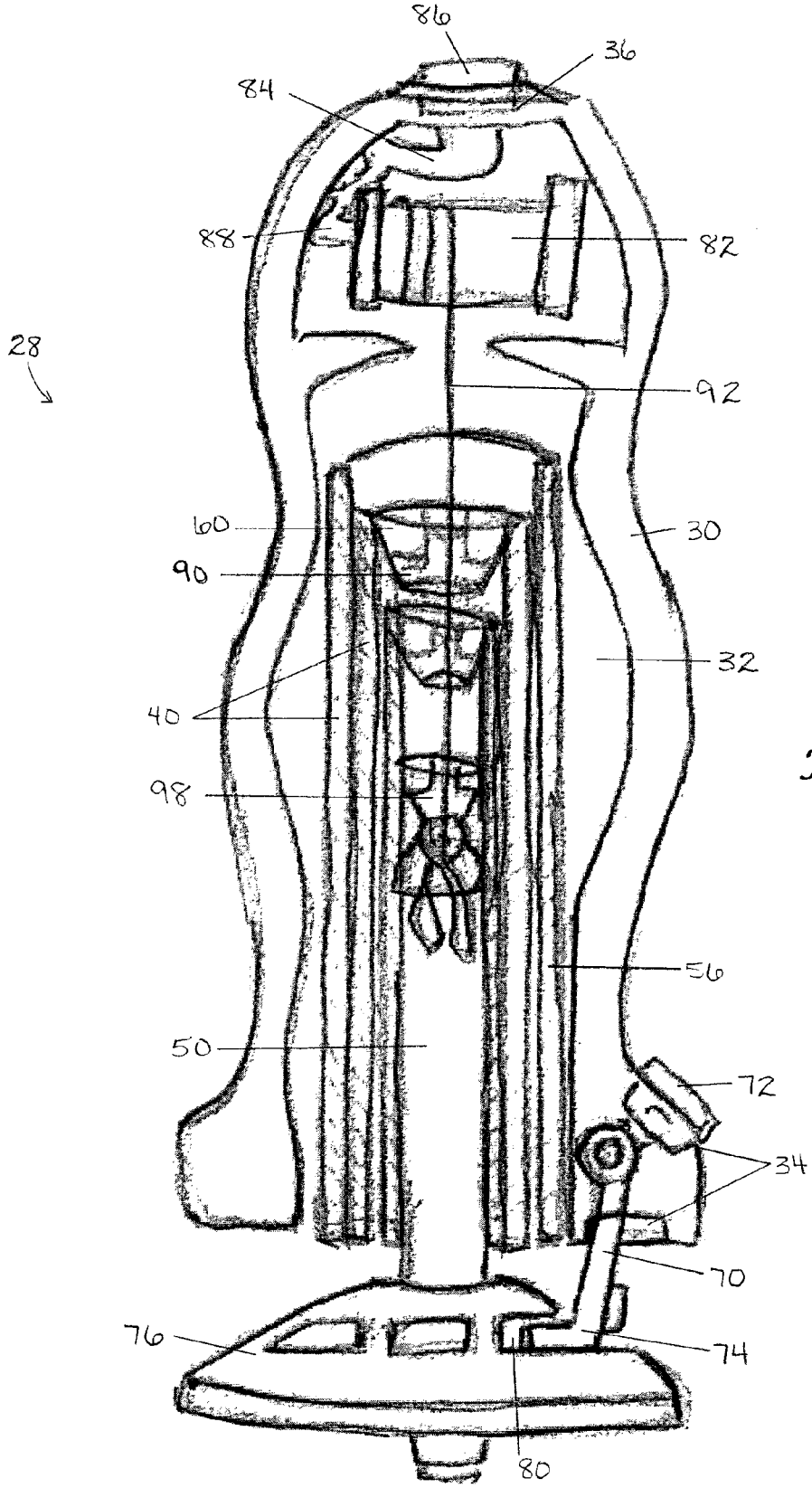
FIG. 7 is a side cross-sectional view of the snow pole of FIG. 5.
Figure 8:
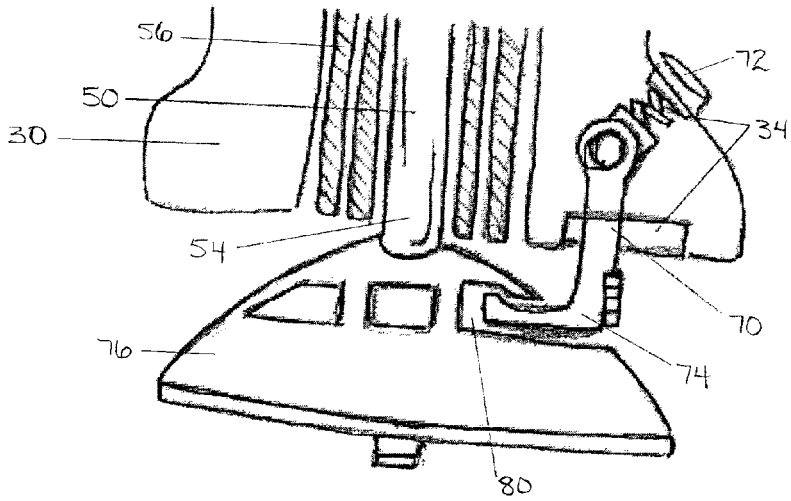
FIG. 8 is a side view of a release lever wherein the L-shaped second end is coupled to an aperture defined by a pole tip coupled to a distal end of an innermost pole member when the snow pole is in a retracted position.
Figure 9:
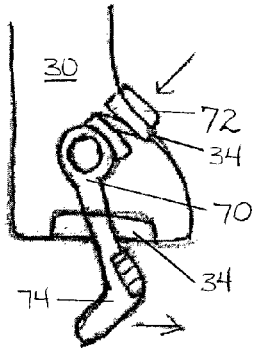
FIG. 9 is a side view of the release lever of FIG. 8, wherein depressing the first end of the release lever causes the L-shaped second end to pivot outwardly.
Figure 10:
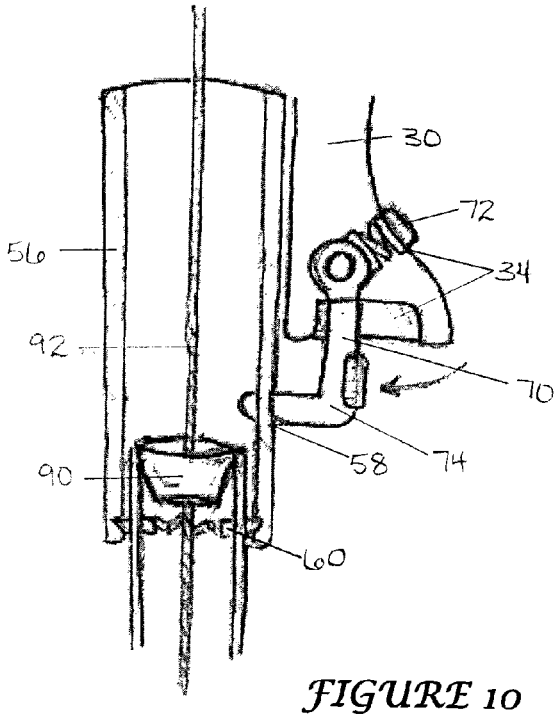
FIG. 10 is a side view of the release lever of FIG. 8 wherein the L-shaped second end is coupled to an aperture defined by an outermost pole member when the snow pole is in an extended position.
Figure 11:
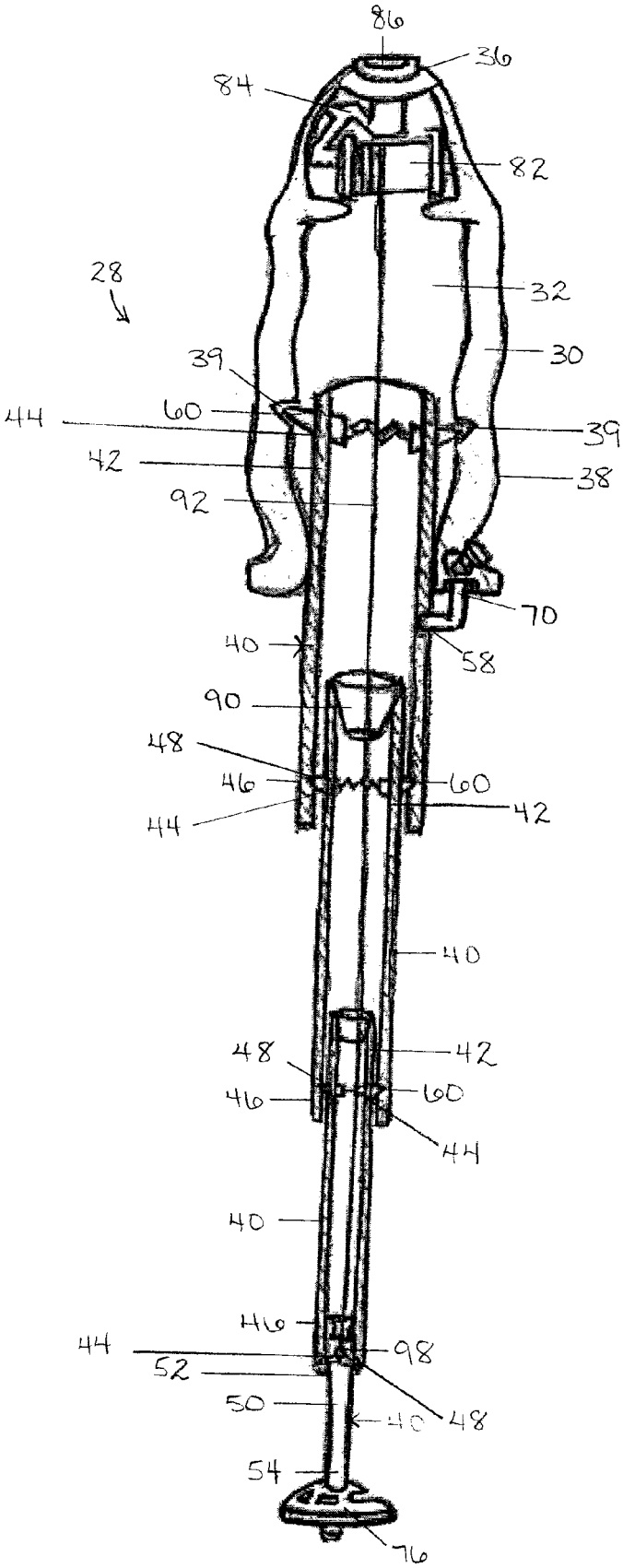
FIG. 11 is a side cross-sectional view of the snow pole of FIG. 6.
Figures 22, 23, 24:
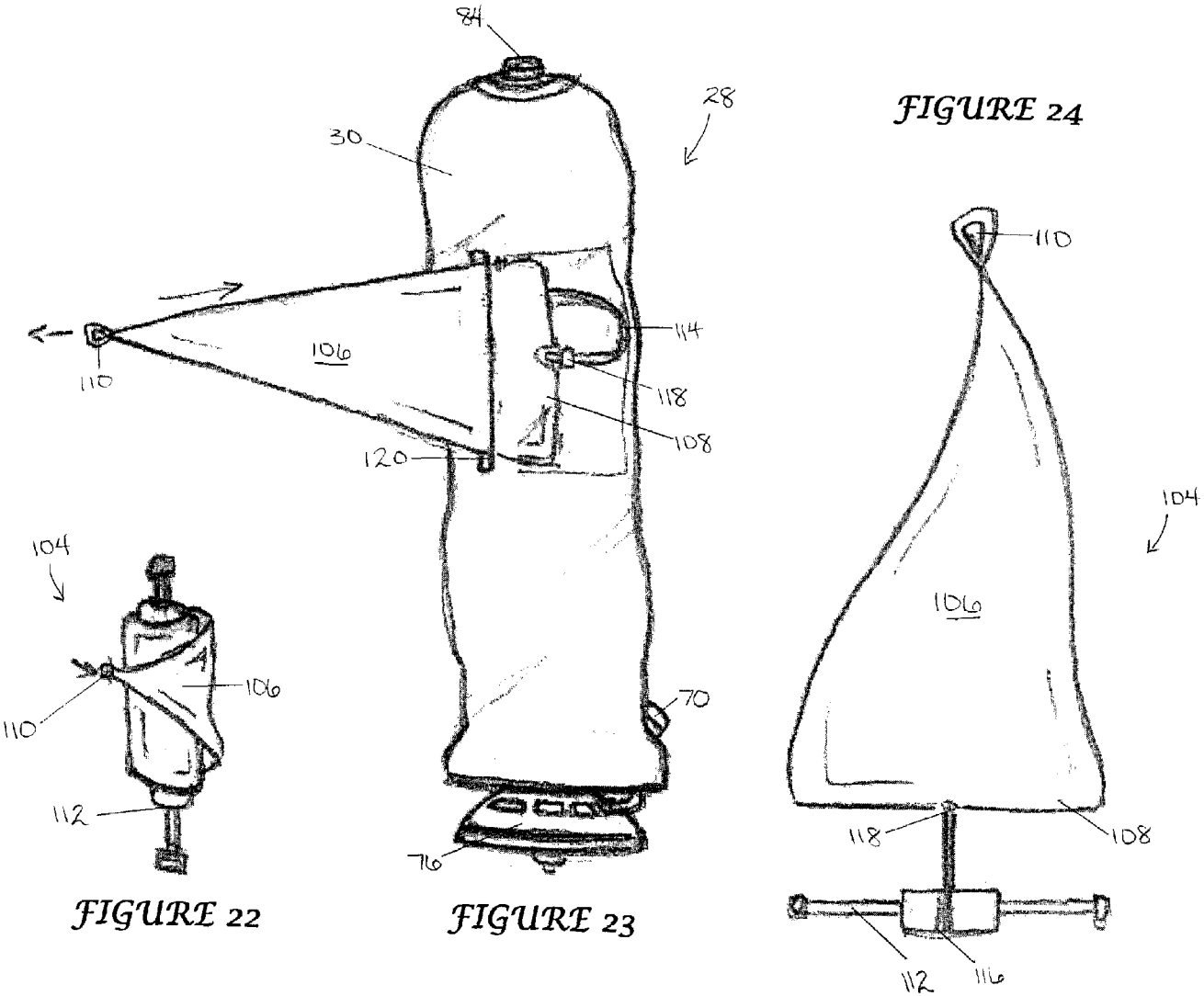
FIG. 22 is a side view of the flag coupled to a spring ratchet.
FIG. 23 is a side view of the flag being deployed from within the housing of the snow pole.
FIG. 24 is side view of the flag coupled to a tension line wrapped about the spring ratchet.

Referring to FIGS. 1-2, the combination 10 of the present invention is shown. The snow pole 28, when in a retracted position, may be coupled to the snowboard binding 12 by at least one clamp lock 14. While the snowboard binding 12 is shown to have two clamp locks 14 coupled thereto, it should be clearly understood that further substantial benefit may be derived from the snowboard binding 12 having only one clamp lock 14 or more than two clamp locks 14.

As shown in FIGS. 1-4, each of the clamp locks 14 defines an aperture 16 dimensioned to secure the snow pole 28 within the clamp lock 14. The clamp locks 14 are preferably coupled to a mounting plate 20 that is coupled to the side portion 18 of the snowboard binding 12. The mounting plate 20 will preferably define two apertures 22 that will align with the apertures 23 defined by the side portion 18 of the snowboard binding 12. A bolt 24 is then passed through a ladder strap 26, the aperture 22 defined by the mounting plate 20, and the aperture 23 defined by the side portion 18 of the snowboard binding 12 in order to secure the mounting plate 20 into place. It should be clearly understood that substantial benefit may be derived from the clamp locks 14 being removably coupled to the side portion 18 of the snowboard binding 12 so that the clamp locks 14 may be used on any snowboard binding 12. Further substantial benefit may be derived from the clamp locks 14 being integral to the side portion 18 of the snowboard binding 12.

Referring to FIGS. 5-6, the snow pole 28 comprises a housing 30, a plurality of telescoping pole members 40 slidably coupled together and located within an interior portion 32 of the housing 30, means for extending the pole members 40 out of the housing 30, and means for retracting the pole members 40 into the housing 30. The snow pole 28 also has a pole tip 76 coupled to the distal end 54 of the innermost pole member 50. The pole tip 76 is the part of the snow pole 28 that engages the snow and preferably is made of carbon, ice steel, or any other suitable durable material.

Turning now to FIGS. 7-18, the means for extending the snow pole 28 out of the housing 30 preferably comprises a release lever 70. The release lever 70 is coupled within the housing 30 and has a first end 72 protruding out of an aperture 34 defined by the housing 30 and has an L-shaped second end 74 protruding out of another aperture 34 defined by the housing 30.

When the snow pole 28 is in a retracted position, the L-shaped second end 74 is removably coupled to an aperture 80 defined by the pole tip 76. By pressing the first end 72 of the release lever 70, the L-shaped second end 74 pivots out from the aperture 80 defined by the pole tip 76. Then, by swinging one's arm, centrifugal force will cause the pole members 40 to extend out of the housing 30. While this is preferred, it should also be clearly understood, however, that substantial benefit may nevertheless be derived from manually extending the pole members 40.

The snow pole 28 preferably has a plurality of locking pins 60 for securing the pole members 28 in an extended position. The locking pins 60 preferably comprise a spring 62 and two L-shaped tabs 64 coupled at opposing ends of the spring 62. The L-shaped tabs 64 preferably have first ends 66 dimensioned to engage opposing apertures 44 defined by a proximal end 42 of a pole member 40 and to engage aligning opposing apertures 39 defined by a distal end 38 of the housing 30 when the snow pole 28 is in an extended position (shown in FIG. 11) or aligning opposing apertures 48 defined by a distal end 46 of a preceding pole member 40. Each L-shaped tab 64 also has a second end 68 oriented downwardly within the pole member 40.

A spring lock 98 is also preferably used to secure the pole members 40 in an extended position. The spring lock 98 has a proximal end 100 coupled to a distal end 96 of the reel line 92. When the pole members 40 are fully extended, the distal end 102 of the spring lock 98 will engage the apertures 44 defined by the proximal end 52 of the innermost pole member 50 and will engage the aligning apertures 48 defined by the distal end 46 of the preceding pole member 40. The L-shaped second end 74 of the release lever 70 may then also be inserted into an aperture 58 defined by the outermost pole member 56.

The means for retracting the snow pole 28 into the housing 30 preferably comprises a spring loaded reel 82, a retraction lever 84, a plurality of tapered stopper rings 90, a length of reel line 92, and a spring lock 98. The retraction lever 84 comprises a first end 86 protruding out of an aperture 36 defined by the housing 30 and an L-shaped second end 88 removably coupled to the spring loaded reel 82.

Each tapered stopper ring 90 is coupled to the proximal end 42 of a pole member 40 and is dimensioned to engage the second ends 68 of the two L-shaped tabs 64 of the locking pin 60 of a preceding pole member 40. A length of reel line 92 has a proximal end 94 that is coupled to the spring loaded reel 82 and a length of the reel line 92 is wound about the spring loaded reel 82. A spring lock 98 has a proximal end 100 that is coupled to a distal end 96 of the reel line 92 and the spring lock 98 has a distal end 102 that is dimensioned to engage at least one aperture 44 defined by a proximal end 52 of the innermost pole member 50 and to also engage at least one aligning aperture 48 defined by the distal end 46 of the preceding pole member 40. Preferably, the distal end 102 of the spring lock 98 comprises two opposing ends with a spring 103 coupled there between and the two opposing ends engage two apertures 44 defined by the proximal end 52 of the innermost pole member 50 and also engage two aligning apertures 48 defined by the distal end 46 of the preceding pole member 40.

By pressing the first end 86 of the retraction lever 84, the L-shaped second end 88 pivots and releases the spring loaded reel 82. As the reel line 92 begins to wind about the spring loaded reel 82, the distal end 102 of the spring lock 98 compresses and disengages from the aligning apertures 48 defined by the distal end 46 of the preceding pole member 40. As the innermost pole member 50 is retracted into the preceding pole member 40, the tapered stopper ring 90 coupled to the proximal end 52 of the innermost pole member 50 engages the second ends 68 of the L-shaped tabs 64 of the locking pin 60 that couples the proximal end 42 of the preceding pole member 40 to the distal end 46 of the next preceding pole member 40. This causes the spring 62 of the locking pin 60 to compress which then causes the first ends 66 of the L-shaped tabs 64 to disengage from the aligning apertures 48 defined by the distal end 46 of the next preceding pole member 40. The first ends 66 of the L-shaped tabs 64, however, do not disengage from the apertures 44 defined by the proximal end 42 of the preceding pole member 40. This helps to keep the locking pins 60 in place when the snow pole 28 is in a retracted position. Alternatively, the locking pins 60 may be coupled to the bottom portion of the tapered stopper rings 90 directly above them (not shown). Each of the pole members 40 retract in similar fashion until all of the pole members 40 have retracted within the housing 30. Once all of the pole members 40 have retracted within the housing 30, the L-shaped second end 74 of the release lever 70 may then be inserted into the aperture 80 defined by the pole tip 76.

Referring to FIGS. 19-24, a flag assembly 104 is shown to be contained within a slit 120 defined by the housing 30. The flag assembly 104 comprises a flag 106, a spring ratchet 112, and a tension line 114. A proximal end 116 of the tension line 114 is coupled to the spring ratchet 112 and a length of the tension line 114 is wrapped about the spring ratchet 112. A proximal end 108 of the flag 106 is coupled to a distal end 118 of the tension line 114 and a distal end 110 of the flag 106 protrudes out of the slit 120 defined by the housing 30. The flag 106 may be deployed from the housing 30, by pulling the distal end 110 of the flag 106. The flag 106 may be returned to its stored position, by pulling again on the distal end 100 of the flag 106 so that the tension line 114 will wind about the spring ratchet 112, thereby retracting the flag 106 back into the slit 120.

While the invention has been particularly shown and described with reference to preferred embodiments thereof, it will be understood by those skilled in the art that the foregoing and other changes in form and details may be made therein without departing from the spirit and scope of the invention. For example, a snow pole 28 having alternative means for retracting and means for extending the pole members 40 may be used in the combination 10. Furthermore, the pole members 40 may be square-shaped, diamond-shaped, oval-shaped, or any other suitable shape.

I claim:

1. A snow pole and snowboard binding combination comprising:

a snow pole; and a snowboard binding having attachment means for removably coupling the snow pole to the snowboard binding, wherein the attachment means comprises at least one clamp lock directly coupled to a side portion of the snowboard binding, the clamp lock defining an aperture dimensioned to secure the snow pole within the clamp lock.

2. The snow pole and snowboard binding combination of claim 1 wherein the attachment means further comprises:

a mounting plate coupled to the side portion of the snowboard binding; and the at least one clamp lock coupled to the mounting plate.

3. The snow pole and snowboard binding combination of claim 2 wherein the mounting plate defines at least two apertures, each aperture for receiving a bolt that couples a ladder strap to the mounting plate and to the side portion of the snowboard binding.

4. A snow pole and snowboard binding combination comprising:

a snow pole comprising:

a housing;

a plurality of telescoping pole members slidably coupled together and having a plurality of locking pins for securing the pole members in an extended position, the pole members being located within an interior portion of the housing;

means for extending the pole members out of the housing, wherein the means for extending the pole members out of the housing comprises a release lever having:

a first end protruding out of an aperture defined by the housing; and an L-shaped second end protruding out of another aperture defined by the housing and removably coupled to an aperture defined by a pole tip coupled to a distal end of an innermost pole member when the snow pole is in a retracted position;

wherein depressing the first end of the release lever causes the L-shaped second end to pivot out from the aperture defined by the pole tip; and means for retracting the pole members into the housing; and a snowboard binding having attachment means for removably coupling the snow pole to the snowboard binding.

5. The snow pole and snowboard binding combination of claim 4 wherein the L-shaped second end is removably coupled to an aperture defined by an outermost pole member when the snow pole is in an extended position.

6. The snow pole and snowboard binding combination of claim 4 wherein each of the plurality of locking pins comprises:

a spring; and two L-shaped tabs coupled at opposing ends of the spring, each L-shaped tab having:

a first end dimensioned to engage an aperture defined by a proximal end of a pole member and to engage an aligning aperture defined by a distal end of one of the housing and a preceding pole member; and a second end oriented downwardly within the pole member.

7. The snow pole and snowboard binding combination of claim 6 wherein the means for retracting the pole members into the housing comprises:

a spring loaded reel;

a retraction lever comprising:

a first end protruding out of an aperture defined by the housing; and an L-shaped second end removably coupled to the spring loaded reel;

wherein depressing the first end of the retraction lever causes the L-shaped second end to pivot and release the spring loaded reel;

a plurality of tapered stopper rings, each stopper ring coupled to the proximal end of the pole member and dimensioned to engage the second ends of the two L-shaped tabs of the locking pin of the preceding pole member;

a length of reel line coupled at a proximal end to the spring loaded reel wherein a length of the reel line is wound about the spring loaded reel; and a spring lock having a proximal end coupled to a distal end of the reel line and having a distal end dimensioned to engage at least one aperture defined by a proximal end of an innermost pole member and to engage at least one aligning aperture defined by a distal end of a preceding pole member.

8. The snow pole of claim 4 wherein the snow pole further comprises a flag assembly stored within the housing, the flag assembly comprising:

a flag;

a spring ratchet for securing the flag in an extended position;

a tension line having a proximal end coupled to the spring ratchet wherein a length of the tension line is wrapped about the spring ratchet;

a proximal end of the flag coupled to a distal end of the tension line; and a distal end of the flag protruding out of the housing.

9. A snow pole and snowboard binding combination comprising:

a snow pole, the snow pole comprising:

a housing;

a plurality of telescoping pole members slidably coupled together and having a plurality of locking pins for securing the pole members in an extended position, the pole members being located within an interior portion of the housing;

a release lever having:

a first end protruding out of an aperture defined by the housing; and an L-shaped second end protruding out of another aperture defined by the housing and removably coupled to an aperture defined by a pole tip coupled to a distal end of an innermost pole member when the snow pole is in a retracted position;

wherein depressing the first end of the release lever causes the L-shaped second end to pivot out from the aperture defined by the pole tip; and means for retracting the pole members into the housing; and a snowboard binding comprising:

a mounting plate coupled to a side portion of the snowboard binding; and at least one clamp lock coupled to the mounting plate.

10. The snow pole and snowboard binding combination of claim 9 wherein each of the plurality of locking pins comprises:

a spring; and two L-shaped tabs coupled at opposing ends of the spring, each L-shaped tab having:

a first end dimensioned to engage an aperture defined by a proximal end of a pole member and to engage an aligning aperture defined by a distal end of one of the housing and a preceding pole member; and a second end oriented downwardly within the pole member.

11. The snow pole and snowboard binding combination of claim 10 wherein the means for retracting the pole members into the housing comprises:

a spring loaded reel;

a retraction lever comprising:

a first end protruding out of an aperture defined by the housing; and an L-shaped second end removably coupled to the spring loaded reel;

wherein depressing the first end of the retraction lever causes the L-shaped second end to pivot and release the spring loaded reel;

a plurality of tapered stopper rings, each stopper ring coupled to the proximal end of the pole member and dimensioned to engage the second ends of the two L-shaped tabs of the locking pin of the preceding pole member;

a length of reel line coupled at a proximal end to the spring loaded reel, a length of the reel line wound about the spring loaded reel; and a spring lock having a proximal end coupled to a distal end of the reel line and having a distal end dimensioned to engage two apertures defined by a proximal end of an innermost pole member and to engage two aligning apertures defined by a distal end of a preceding pole member.

12. The snow pole of claim 9 wherein the snow pole further comprises a flag assembly stored within the housing, the flag assembly comprising:

a flag;

a spring ratchet for securing the flag in an extended position;

a tension line having a proximal end coupled to the spring ratchet, a length of the tension line wrapped about the spring ratchet;

a proximal end of the flag coupled to a distal end of the tension line;

a distal end of the flag protruding out of the housing.

13. A snow pole and snowboard binding combination comprising:

a snow pole, the snow pole comprising:

a housing;

a plurality of telescoping pole members slidably coupled together and having a plurality of locking pins for securing the pole members in an extended position, the pole members being located within an interior portion of the housing;

means for extending the pole members out of the housing, wherein the means for extending the pole members out of the housing comprises a release lever having:

a first end protruding out of an aperture defined by the housing; and an L-shaped second end protruding out of another aperture defined by the housing removably coupled to an aperture defined by a pole tip coupled to a distal end of an innermost pole member when the snow pole is in a retracted position;

wherein depressing the first end of the release lever causes the L-shaped second end to pivot out from the aperture defined by the pole tip;

means for retracting the pole members into the housing; and an emergency flag assembly contained within the housing; and a snowboard binding having attachment means for removably coupling the snow pole to the snowboard binding.

14. The snow pole and snowboard binding combination of claim 13 wherein the flag assembly comprises:

a flag;

a spring ratchet for securing the flag in an extended position;

a tension line having a proximal end coupled to the spring ratchet, a length of the tension line wrapped about the spring ratchet;

a proximal end of the flag coupled to a distal end of the tension line;

a distal end of the flag protruding out of the housing.

15. The snow pole and snowboard binding combination of claim 13 wherein the attachment means for removably coupling the snow pole to the snowboard binding comprises:

a mounting plate coupled to a side portion of the snowboard binding;

two clamp locks coupled to the mounting plate; and two apertures defined by the mounting plates, the two apertures dimensioned to align with two apertures defined by the side portion of the snowboard binding and to receive a bolt that couples a ladder strap to the mounting plate and to the side portion of the snowboard binding.

16. The snow pole and snowboard binding combination of claim 13 wherein each of the plurality of locking pins comprises:

a spring; and two L-shaped tabs coupled at opposing ends of the spring, each L-shaped tab having:

a first end dimensioned to engage an aperture defined by a proximal end of a pole member and to engage an aligning aperture defined by a distal end of one of the housing and a preceding pole member; and a second end oriented downwardly within the pole member.

17. The snow pole and snowboard binding combination of claim 16 wherein the means for retracting the pole members into the housing comprises:

a spring loaded reel;

a retraction lever comprising:

a first end protruding out of an aperture defined by the housing; and an L-shaped second end removably coupled to the spring loaded reel;

wherein depressing the first end of the retraction lever causes the L-shaped second end to pivot and release the spring loaded reel;

a plurality of tapered stopper rings, each stopper ring coupled to the proximal end of the pole member and dimensioned to engage the second ends of the two L-shaped tabs of the locking pin of the preceding pole member;

a length of reel line coupled at a proximal end to the spring loaded reel, a length of the reel line wound about the spring loaded reel; and a spring lock having a proximal end coupled to a distal end of the reel line and having a distal end dimensioned to engage at least one aperture defined by a proximal end of an innermost pole member and to engage at least one aligning aperture defined by a distal end of a preceding pole member.

* * * * *